US008919568B2

(12) United States Patent
Beck et al.

(10) Patent No.: US 8,919,568 B2
(45) Date of Patent: Dec. 30, 2014

(54) SCREENING FOR CLASSIFYING A MATERIAL

(75) Inventors: Jeffrey L. Beck, Honey Brook, PA (US); Myron Henry Wardell, Lititz, PA (US); Boyd E. Knepp, Lancaster, PA (US)

(73) Assignee: Lumsden Corporation, Lancaster, PA (US)

( * ) Notice: Subject to any disclaimer, the term of this patent is extended or adjusted under 35 U.S.C. 154(b) by 447 days.

(21) Appl. No.: 13/137,834

(22) Filed: Sep. 15, 2011

(65) Prior Publication Data

US 2013/0068668 A1 Mar. 21, 2013

(51) Int. Cl.
*B07B 1/46* (2006.01)

(52) U.S. Cl.
CPC ..... *B07B 1/4672* (2013.01); *B07B 1/4681* (2013.01)
USPC ..... 209/401; 209/403

(58) Field of Classification Search
CPC ..... B07B 1/46; B07B 1/4672; B07B 1/4681
USPC ..... 209/379, 392, 400, 401, 403
See application file for complete search history.

(56) References Cited

U.S. PATENT DOCUMENTS

| | | | | |
|---|---|---|---|---|
| 2,604,989 | A | 7/1952 | Warhol | |
| 2,926,785 | A | 3/1960 | Sander | |
| 3,716,138 | A | 2/1973 | Lumsden | |
| 4,239,065 | A * | 12/1980 | Trokhan | 139/383 AA |
| 4,491,517 | A | 1/1985 | Janovac | |
| 4,756,946 | A | 7/1988 | Mercer | |
| 4,857,176 | A | 8/1989 | Derrick et al. | |
| 5,598,930 | A * | 2/1997 | Leone et al. | 209/403 |
| 5,673,797 | A | 10/1997 | Bakula et al. | |
| 5,888,336 | A | 3/1999 | Bakula et al. | |
| 6,457,588 | B1 | 10/2002 | Schulte et al. | |
| 6,565,698 | B1 | 5/2003 | Adams et al. | |
| 6,932,883 | B2 | 8/2005 | Adams et al. | |
| 7,581,569 | B2 | 9/2009 | Beck | |

(Continued)

FOREIGN PATENT DOCUMENTS

| | | |
|---|---|---|
| JP | 05-146613 | 6/1993 |
| JP | 06-246796 | 9/1994 |

OTHER PUBLICATIONS

Lumsden two page brochure entitled "Hoyt H-Wave Screens" published at least as early as Sep. 14, 2010.

(Continued)

*Primary Examiner* — Joseph C Rodriguez
(74) *Attorney, Agent, or Firm* — Merek, Blackmon & Voorhees, LLC

(57) ABSTRACT

A screening having a plurality of warp elements. The plurality of warp elements includes first and second warp elements each having a plurality of undulations oriented in any desired manner including but not limited to horizontal or vertical. At least one retaining member is operably associated with the plurality of warp elements to form an integral screen segment having a plurality of openings. The first warp element has at least one characteristic different from the second warp element to prevent blinding of the screen segment. The at least one characteristic affecting movement of the first warp element and the second warp element when the screen segment is used to classify material such that at least one of amplitude and frequency of movement of the first warp screening element is different from that of the second warp element when subjected to the same operating condition.

26 Claims, 8 Drawing Sheets

(56) References Cited

U.S. PATENT DOCUMENTS

| | | | | |
|---|---|---|---|---|
| 7,815,053 | B2 | 10/2010 | Knepp | |
| 7,980,392 | B2 * | 7/2011 | Larson et al. | 209/392 |
| 8,196,753 | B2 * | 6/2012 | Freissle | 209/401 |
| 8,353,407 | B2 * | 1/2013 | Steadman | 209/400 |
| 2010/0307961 | A1 * | 12/2010 | Van Rensburg | 209/392 |

OTHER PUBLICATIONS

Lumsden two page brochure entitled "Hoyt Serpa Screens" published at least as early as Sep. 14, 2010.

Lumsden two page brochure entitled "Hoyt Veno Screens" and two sheets of Specifications for Hoyt Veno Screens publicly available at least as early as Sep. 14, 2010.

Lumsden two page brochure entitled "Introducing Hoyt Veno Harp Screen" published at least as early as Sep. 14, 2010.

Lumsden two page brochure entitled "Hi-Rise Screens" published at least as early as Sep. 14, 2010.

Major Wire Industries Limited two page brochure entitled "Flex-Mat®3 Specifications" published Jun. 2005.

Major Wire Industries Limited one page brochure entitled "Maximize Your Screening Output on All Decks With Flex-Mat®3" published 2006.

Major Wire Industries Limited eight page brochure entitled "High-Performance Screen Media" published Mar. 2010.

* cited by examiner

SCREENING FOR CLASSIFYING A MATERIAL

FIELD OF THE INVENTION

The present invention is directed to a screening for classifying a material. More particularly, a preferred embodiment of the present invention is directed to a screening used in a shaker or vibrating screen apparatus that classifies material flowing through one or more screenings. The screening includes a plurality of warp screening elements. Preferably, the plurality of warp screening elements is a plurality of warp wires. The plurality of warp screening elements includes a first warp screening element having a plurality of undulations. The plurality of warp screening elements further includes a second warp screening element having a plurality of undulations. The plurality of undulations of the first and second warp screening elements may be oriented in any desired manner including but not limited to a horizontal orientation and a vertical orientation. At least one retaining member is operably associated with the plurality of warp screening elements to form an integral screen segment having a plurality of openings for permitting material to be classified to pass through the openings. The at least one retaining member may take any desired form including but not limited to one or more weft wires, one or more weft screening elements formed from a non-metallic material and one or more hooks secured to the side edges of the integral screen segment. The integral screen segment may take the form of a woven wire screen, a non-woven wire screen or a combination of woven and non-woven screen segments. The first warp screening element has at least one characteristic different from the second warp screening element to prevent blinding of the integral screen segment. The at least one characteristic affecting movement of the first warp screening element and the second warp screening element when the integral screen segment is used to classify material such that at least one of amplitude and frequency of movement of the first warp screening element is different from at least one of amplitude and frequency of movement of the second warp screening element when the first warp screening element and the second warp screening element are subject to the same operating condition. In the most preferred form, the at least one characteristic is spring rate.

BACKGROUND OF THE INVENTION

One or more screenings or screens have been used in shaker or vibrating screen apparatus to size material passing through the screens. Known screens/screenings typically consist of a plurality of warp screening elements and a plurality of retaining members operably associated with the warp screening elements to form an integral screen segment having a plurality of openings for permitting suitably sized material to pass through the screen. The warp screening elements can be wires or plastic members. The openings can be square, rectangular or diamond shaped. Alternatively, the screen can be formed as a long slot screen where the warp screening elements are maintained in spaced parallel relation by retaining members arranged in groups of three at spaced intervals along the length of the warp screening elements. The retaining members can be weft wires.

Screen design is problematic as numerous factors can adversely impact the performance and longevity of the screen. For example, the through put of the screen is extremely important as a screen which does not allow for efficient sizing or grading of material will not meet commercial demands although the screen can satisfactorily classify material. Another significant factor is the ability of the screen to maintain the desired opening size to ensure that material passing through the screen can be accurately classified. A further significant factor is the ability of the screen to avoid blinding. Specifically, where one or more openings in the screen become partially or completely obstructed by material or foreign matter, the performance of the screen greatly deteriorates. Moreover, the longevity of the screen is an important factor to the commercial success of the screen.

Conventional screens have been unable to address one or more of the aforementioned factors to the detriment of the screen and it commercial success.

OBJECTS AND SUMMARY OF THE INVENTION

An object of the present invention is to provide a novel and unobvious screening.

Another object of a preferred embodiment of the present invention is to provide a screen that is designed to be self-cleaning to avoid blinding of the screen.

A further object of a preferred embodiment of the present invention is to enhance tumbling of material on the screen to maximize through put.

Yet another object of a preferred embodiment of the present invention is to provide a screening that has warp screening elements that are designed to promote self-cleaning of the screen to avoid blinding of the screen.

Still another object of a preferred embodiment of the present invention is to provide a screening that has warp screening elements with differing spring rates to promote self-cleaning of the screen and avoid blinding of the screen.

Yet still another object of a preferred embodiment of the present invention is to provide a screening that has a first set of warp screening elements and a second set of warp screening elements where the first set of warp screening elements have at least one characteristic different from the second set of warp screening elements affecting movement of the first set of warp screening elements and the second set of warp screening elements when the screening is used to classify material such that at least one of amplitude and frequency of movement of the first set of warp screening elements is different from at least one of amplitude and frequency of movement of the second set of warp screening elements when the first set of warp screening elements and the second set of warp screening elements are subject to the same operating condition.

A further object of a preferred embodiment of the present invention is to provide a screening having a first set of warp screening elements with a hardness different from the hardness of a second set of warp screening elements that fosters self-cleaning even where the size and shape of the first set of warp screening elements is the same as the size and shape of the second set of warp screening elements.

It must be understood that no one embodiment of the present invention need include all of the aforementioned objects of the present invention. Rather, a given embodiment may include one or none of the aforementioned objects. Accordingly, these objects are not to be used to limit the scope of the claims of the present invention.

In summary, a preferred embodiment of the present invention is directed to a screening for use in classifying material flowing through the screening. The screening includes a plurality of warp screening elements. The plurality of warp screening elements includes a first warp screening element having a plurality of horizontal undulations. The plurality of warp screening elements further includes a second warp screening element having a plurality of horizontal undulations. At least one retaining member is operably associated with the plurality of warp screening elements to form an integral screen segment having a plurality of openings for permitting material to be classified to pass through the openings. The first warp screening element has at least one characteristic different from the second warp screening element to prevent blinding of the integral screen segment. The at least one characteristic affects movement of the first warp screening element and the second warp screening element when the integral screen segment is used to classify material such that at least one of amplitude and frequency of movement of the first warp screening element is different from at least one of amplitude and frequency of movement of the second warp screening element when the first warp screening element and the second warp screening element are subject to the same operating condition.

Another preferred embodiment of the present invention is directed to a screening for use in classifying material flowing through the screening. The screening includes a plurality of warp screening elements. The plurality of warp screening elements includes a first warp screening element. The first warp screening element has an uppermost surface and a lowermost surface. The plurality of warp screening elements further includes a second warp screening element. The second warp screen element has an uppermost surface and a lowermost surface. At least one retaining member is operably associated with the plurality of warp screening elements to form an integral non-woven screen segment having a plurality of openings for permitting material to be classified to pass through the openings. At least one retaining member positioning the first warp screening element and the second warp screening element such that one of the following two conditions exist: (i) the lowermost surface of the first warp screening element and the lowermost surface of the second warp screening element are in a first horizontal plane and the uppermost surface of the first warp screening element is a predetermined distance above the uppermost surface of the second warp screening element. The uppermost surface of the first warp screening element and the uppermost surface of the second warp screening element are in a second horizontal plane and the lowermost surface of the first warp screening element is a predetermined distance below the lowermost surface of the second warp screening element.

A further preferred embodiment of the present invention is directed to a screening for use in classifying material flowing through the screening. The screening includes a plurality of warp screening elements. The plurality of warp screening elements includes a first warp screening element. The first warp screening element has a first hardness. The plurality of warp screening elements further includes a second warp screening element having a second hardness. The first hardness is different from the second hardness. At least one retaining member is operably associated with the plurality of warp screening elements to form an integral screen segment having a plurality of openings for permitting material to be classified to pass through the openings. The at least one retaining member permitting movement of the first warp screening element and the second warp screening element when the integral screen segment is used to classify material where the difference in hardness between the first warp screening element and the second warp screening element causes at least one of amplitude and frequency of movement of the first warp screening element and at least one of amplitude and frequency of movement of the second warp screening element to be different when the first warp screening element and the second warp screening element are subject to the same operating condition.

Yet another preferred embodiment of the present invention is directed to a screening for use in classifying material flowing through the screening. The screening includes a plurality of warp screening elements. The plurality of warp screening elements includes a first warp screening element having a plurality of undulations. The plurality of warp screening elements further includes a second warp screening element having a plurality of undulations. At least one of the first warp screening element and the second warp screening element has two substantially flat sidewall portions. At least one retaining member is operably associated with the plurality of warp screening elements to form an integral screen segment having a plurality of openings for permitting material to be classified to pass through the openings. The first warp screening element has a first spring rate. The second warp screening element has a second spring rate. The second spring rate is different from the first spring rate.

Still another preferred embodiment of the present invention is directed to a screening for use in classifying material flowing through the screening. The screening includes a plurality of warp screening elements. The plurality of warp screening elements includes a first warp screening element having a plurality of undulations. The plurality of warp screening elements further includes a second warp screening element having a plurality of undulations. At least one of the first warp screening element and the second warp screening element has two substantially flat sidewall portions. At least one retaining member is operably associated with the plurality of warp screening elements to form an integral screen segment having a plurality of openings for permitting material to be classified to pass through the openings. The first warp screening element has at least one characteristic different from the second warp screening element to prevent blinding of the integral screen segment. The at least one characteristic affecting movement of the first warp screening element and the second warp screening element when the integral screen segment is used to classify material such that at least one of amplitude and frequency of movement of the first warp screening element is different from at least one of amplitude and frequency of movement of the second warp screening element when the first warp screening element and the second warp screening element are subject to the same operating condition.

DETAILED DESCRIPTION OF THE PREFERRED EMBODIMENTS OF THE INVENTION

The preferred forms of the invention will now be described with reference to FIGS. 1-13. The appended claims are not limited to the preferred forms and no term and/or phrase used herein is to be given a meaning other than its ordinary meaning unless it is expressly stated that the term and/or phrase shall have a special meaning.

FIGS. 1-5

Figure 1:
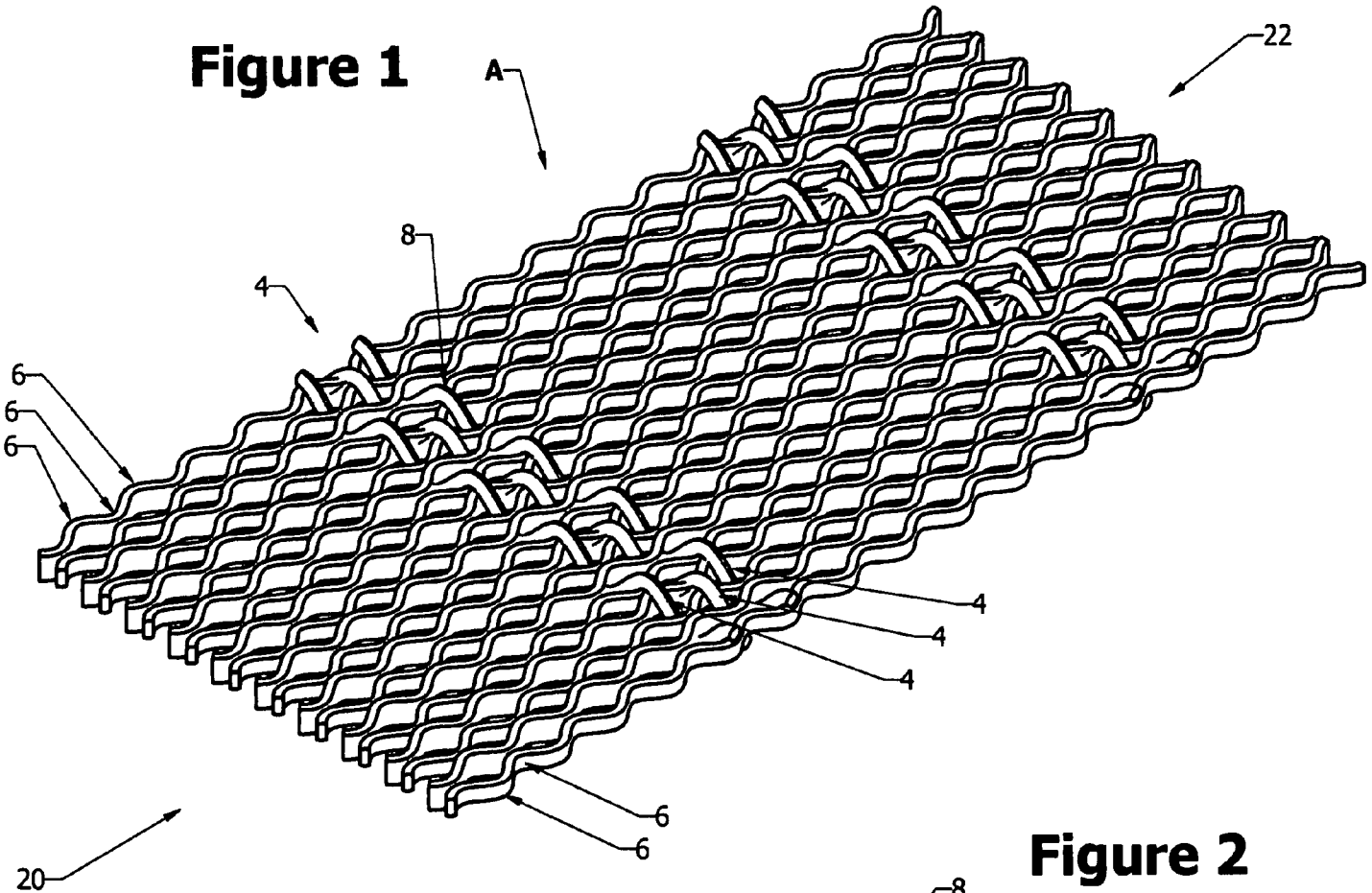
FIG. 1 is a perspective view of a portion of an integral woven wire screening or screen formed in accordance with a preferred embodiment of the present invention.
Figure 2:
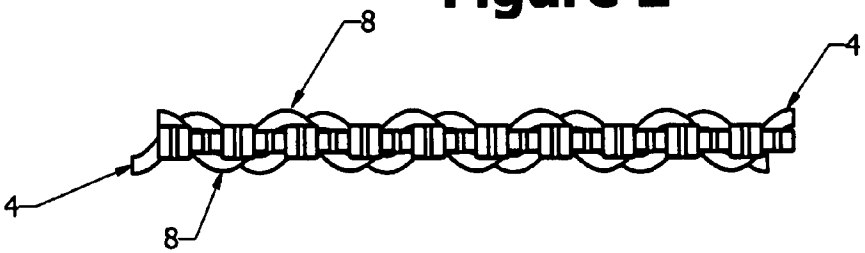
FIG. 2 is a side elevational view of the screening illustrated in FIG. 1.
Figure 3:
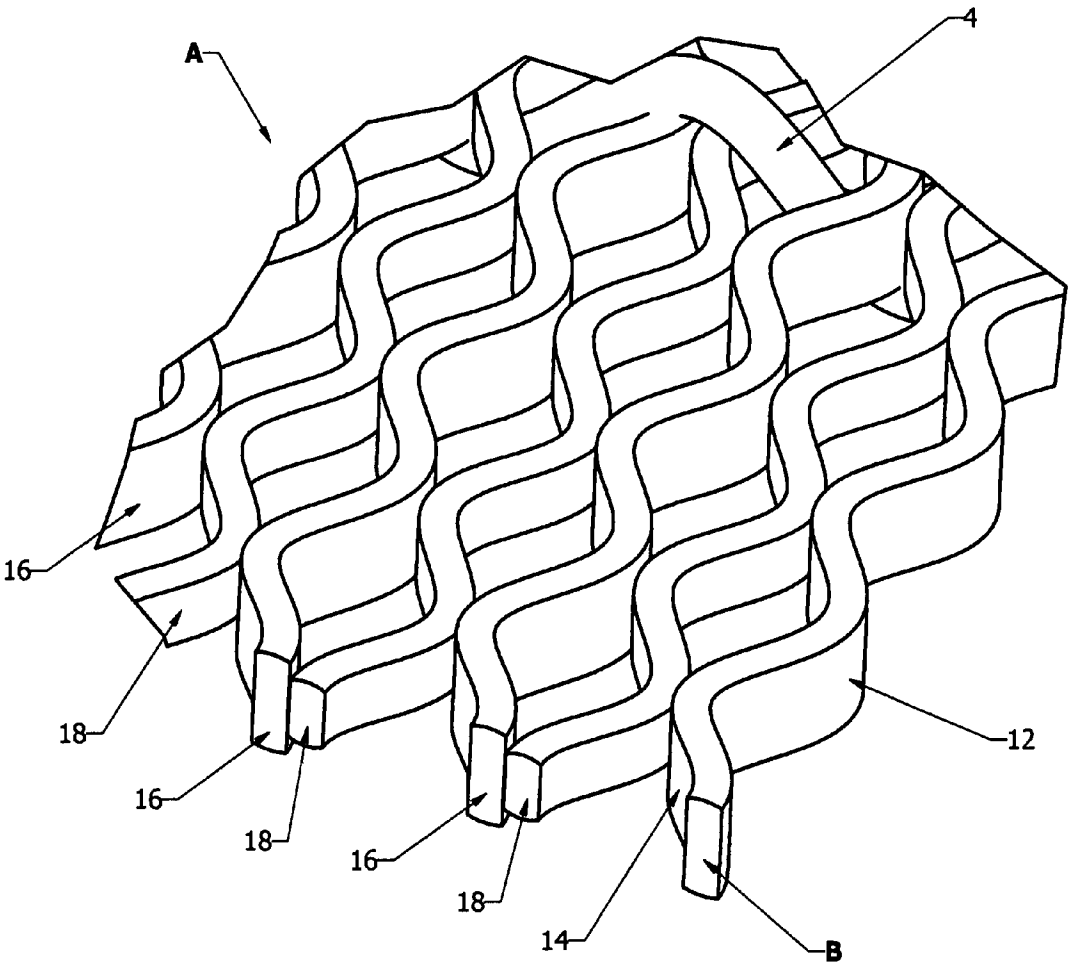
FIG. 3 is an enlarged fragmentary perspective view of an integral woven wire screening of the type illustrated in FIG. 1.

Referring to FIGS. 1 to 3, a portion of an integral woven wire screening or screen A formed in accordance with a preferred embodiment of the present invention is illustrated in one of many possible configurations. It will be readily appreciated that the size of screen A can be varied as desired. Screen A includes a plurality of interwoven warp screening elements 2 and weft screening elements 4. The warp screening elements 2 are generally oriented perpendicular to the direction of flow of material on the screen surface formed by the uppermost portions of the warp screening elements 2. However, the warp screening elements can be oriented in any desired manner including but not limited to parallel to the direction of flow of material over the screening surface. Preferably, the weft screening elements 4 are grouped in threes at spaced intervals along the length of the warp screening elements 2 to maintain the warp screening elements in a desired position. The spacing of the groups of welt screening elements 4 may be varied as desired. The weft screening elements 4 may be coated with a protective material (e.g., polyurethane) to prolong the life of the weft screening elements 4. In the most preferred form of this embodiment of the invention, the warp and weft screening elements are formed from wires of standard wire size. Standard wire sizes are identified in column 4 of U.S. Pat. No. 3,716,138. Wire sizes as used herein refer to standard wire sizes. While the warp and weft screening elements are preferably formed from wires, it will be readily appreciated that the warp and weft screening elements can be made from any suitable material including but not limited to non-metallic materials (e.g., polyurethane).

Each of the warp screening elements 2 preferably include a plurality of horizontal undulations 6 along the length of the of the warp screening elements. Horizontal undulations 6 may be formed by crimping or any other suitable process. Horizontal undulations as used herein refer to undulations that extend along the screening surface. It should be noted that screen A typically is bowed or curved when in use in a shaker or vibrating screen apparatus. However, it should appreciated that the screen A may be planar. Each of the weft screening elements 4 preferably include a plurality of vertical undulations 8 along the length of the of the weft screening elements. Vertical undulations 8 may be formed by crimping or any other suitable process. Vertical undulations as used herein refer to undulations that extend at an angle to the screening surface. As readily seen in FIG. 3, unlike round wires, the warp screening elements 2 preferably have two flat sidewalls 10 and 12 such that the thickness B of the warp screening elements 2 do not substantially vary over the height of the warp screening elements 2. In the most preferred form of this embodiment of the invention, the weft screening elements are round wires.

Directly adjacent pairs of warp screening elements 2 form a plurality of openings 14 of a predetermined size. The size of the openings 14 can be readily varied by varying the size and shape of the warp screening elements 2. The size of the openings 14 can be readily varied by also varying the size and shape of the horizontal undulations 6. While openings 14 are illustrated as being four-sided (all four sides being formed from directly adjacent warp screening elements 2) and substantially diamond shape, it will be readily appreciated that the openings may be of any suitable configuration including but not limited to rectangular or square. Further, screen A can be formed as a long slot screen where the warp screening elements 2 are maintained in spaced parallel relation by weft screening elements arranged in groups of three at spaced intervals along the length of the warp screening elements.

Figure 4:
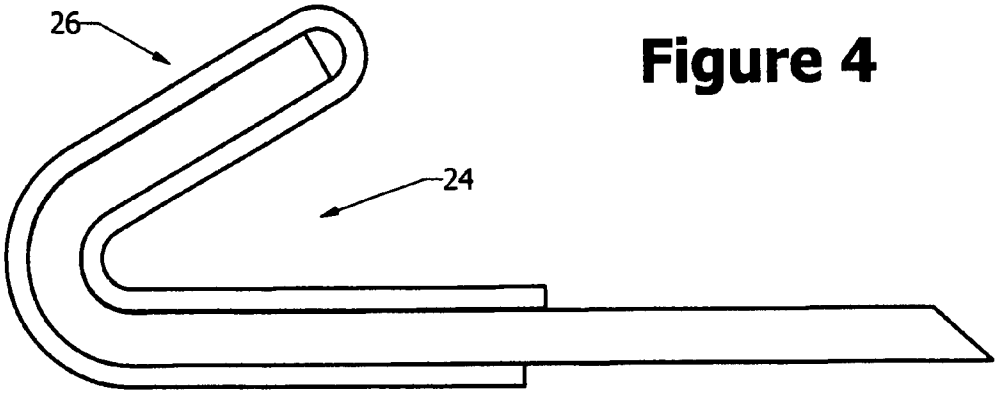
FIG. 4 is a side elevational view of a hook used to connect a screen to a shaker or other vibrating screen apparatus. Typically, a hook is connected at each end of the plurality of warp screening elements, i.e., each screening typically includes two hooks.
Figure 5:
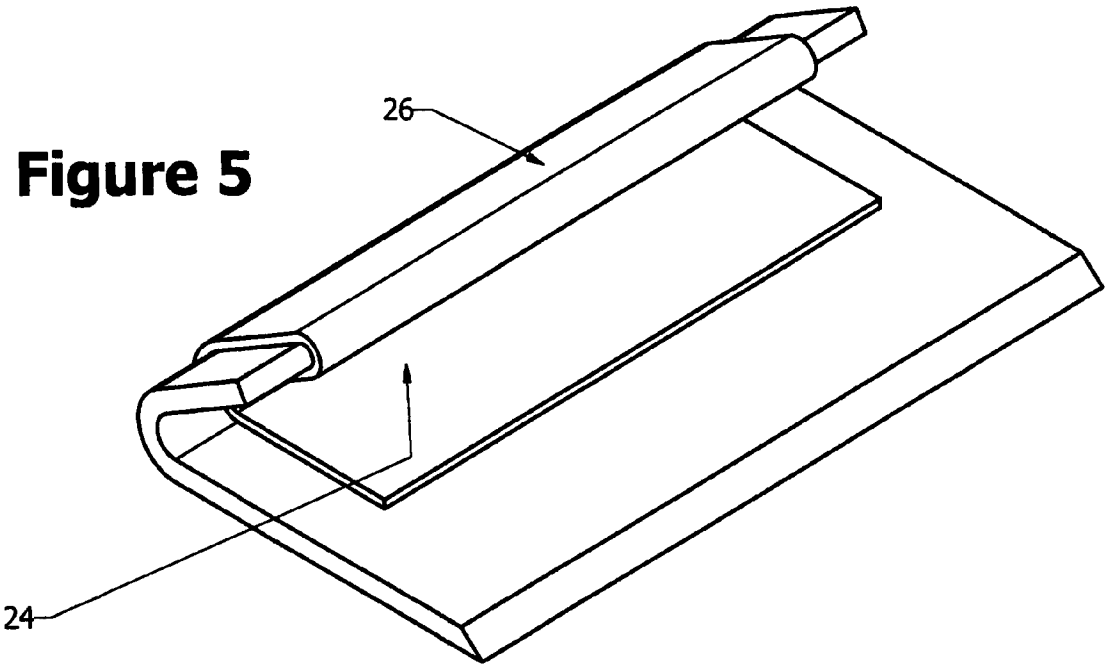
FIG. 5 is a perspective view of the hook illustrated in FIG. 4.

Referring to FIGS. 1 to 3, the warp screening elements 2 are of two different types. In the most preferred embodiment of the present invention, the warp screening elements alternate between a large screening element 16 and a small screening element 18. For example, the large warp screening elements 16 can be formed from a wire having a wire size of 0.148 inches while the small warp screening elements can be formed from a wire having a wire size of 0.120 inches. The large warp screening elements 16 can be crimped so that the undulations have a width (or depth when rotated ninety degrees) of 0.363 inches. The small warp screening elements 18 can be crimped so that the undulations have a width (or depth when rotated ninety degrees) of 0.355 inches. This will form an integral woven wire screen segment having 7/16 inch classification openings. Referring to FIGS. 1, 4 and 5, ends 20 and 22 are inserted into area 24 of hook 26. Hooks 26 are attached to ends 20 and 22 by a metal working machine. The difference in size of the warp screening elements leads to the large screening elements and small screening elements being placed under different tensions which causes the spring rates (inches deflection/inch length/pound) to be different. In the above example, the warp screening element formed from a wire size of 0.148 inches will have a spring rate of 0.00019 in/ft/lb while the warp screening element formed from a wire size of 0.120 inches will have a spring rate of 0.00094 in/ft/lb. In this example, the ratio of the spring rate of small warp screening elements 18 to the spring rate of the large warp screening elements 16 would be 4.89 (0.00094/0.00019). By vary the spring rates of elements 16 and 18, the amplitude and/or frequency of movement of elements 16 and 18 differs when elements 16 and 18 are subjected to the same or similar operating conditions during the classification process. By differing the amplitude and/or frequency of movement of elements 16 and 18 during the classification process, screen A is self-cleaning, i.e., blinding does not occur or is substantially reduced. It should be noted that the spring rate of the warp screening elements can be varied even though all of the warp screening elements have the same size and configuration. For example, the hardness of alternating warp wires can be varied to vary the spring rate between adjacent warp screening elements. In this embodiment, all warp wires would have the same shape and size but every other warp wire would have a different hardness. Further, the spring rate can be varied by varying the size and hardness of alternating warp screening elements. For example, the large warp screening elements 16 can be formed from a wire having a wire size of 0.250 inches and a hardness of 42Rc while the small warp screening elements 18 can be formed from a wire having a size of 0.270 inches and a hardness of 45Rc. The large warp screening elements 16 can be crimped so that the undulations have a width (or depth when rotated ninety degrees) of 0.687 inches. The small warp screening elements 18 can be crimped so that the undulations have a width (or depth when rotated ninety degrees) of 0.677 inches. This will form an integral woven wire screen segment having 1 inch classification openings. The spring rate of the large warp screening element 16, in this example, would be 0.0069 in/ft/lb while the spring rate of the small warp screening element 18 would be 0.00058 in/ft/lb. It should be noted that in this example the large warp screening element has a higher spring rate than the smaller warp screening element unlike the prior example in which the smaller warp screening element had a considerably higher spring rate than the larger warp screening element. The spring rates of the warp screening elements can be varied in other manners including varying the shape of the warp screening element, e.g. alternating flat and round warp screening elements in the same integral screen segment.

Figure 6:
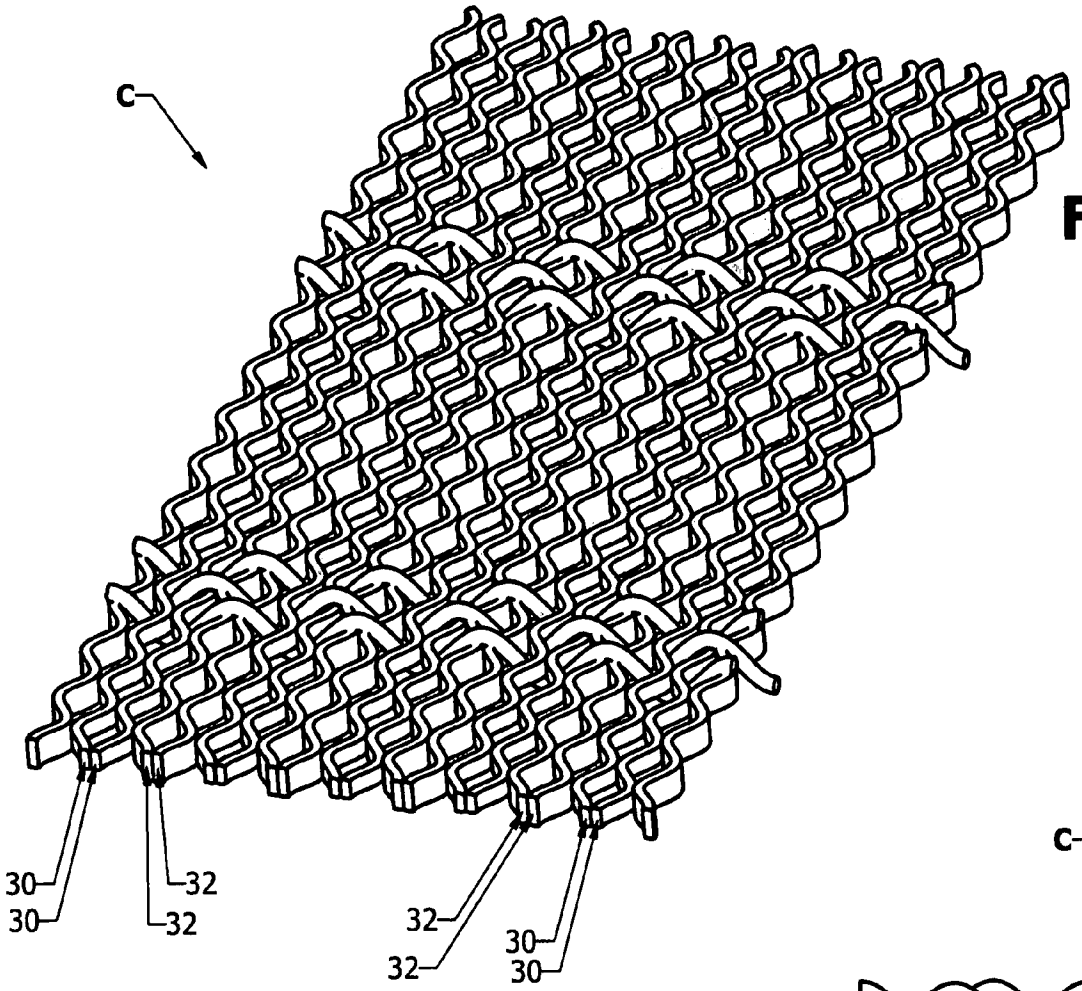
FIG. 6 is a perspective view of a portion of an integral woven wire screening or screen formed in accordance with another preferred embodiment of the present invention.
Figure 7:
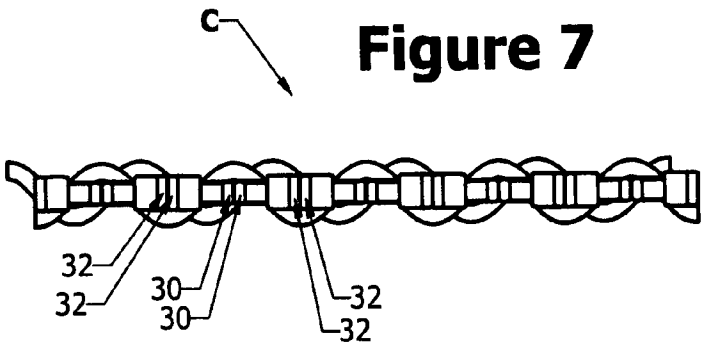
FIG. 7 is a side elevational view of the screening illustrated in FIG. 6.

FIGS. 6 and 7

Referring to FIGS. 6 and 7, a portion of an integral woven wire screening or screen C formed in accordance with another preferred embodiment of the present invention is illustrated in one of many possible configurations. It will be readily appreciated that the size of screen C can be varied as desired. Screen C is similar to screen A and, therefore, only the differences will be described in detail. The warp screening elements in this embodiment are arranged such that small warp screening elements 30 and large warp screening elements 32 are grouped in pairs with every other pair differing in size. It should be noted that instead of varying the size of the warp screening elements, the hardness of the warp screening elements can be varied. For example, elements 30 can be of a given hardness while elements 32 are of a different hardness. It should also be noted that both the size and hardness of elements 30 and 32 may be varied to vary the spring rate. It should also be noted that the arrangement of the warp screening elements having at least one characteristic that differs from other warp screening elements to affect the amplitude and/or frequency of movement of elements 30 and 32 when the elements 30 and 32 are subjected to similar or the same operating conditions may be varied as desired.

Figure 8:
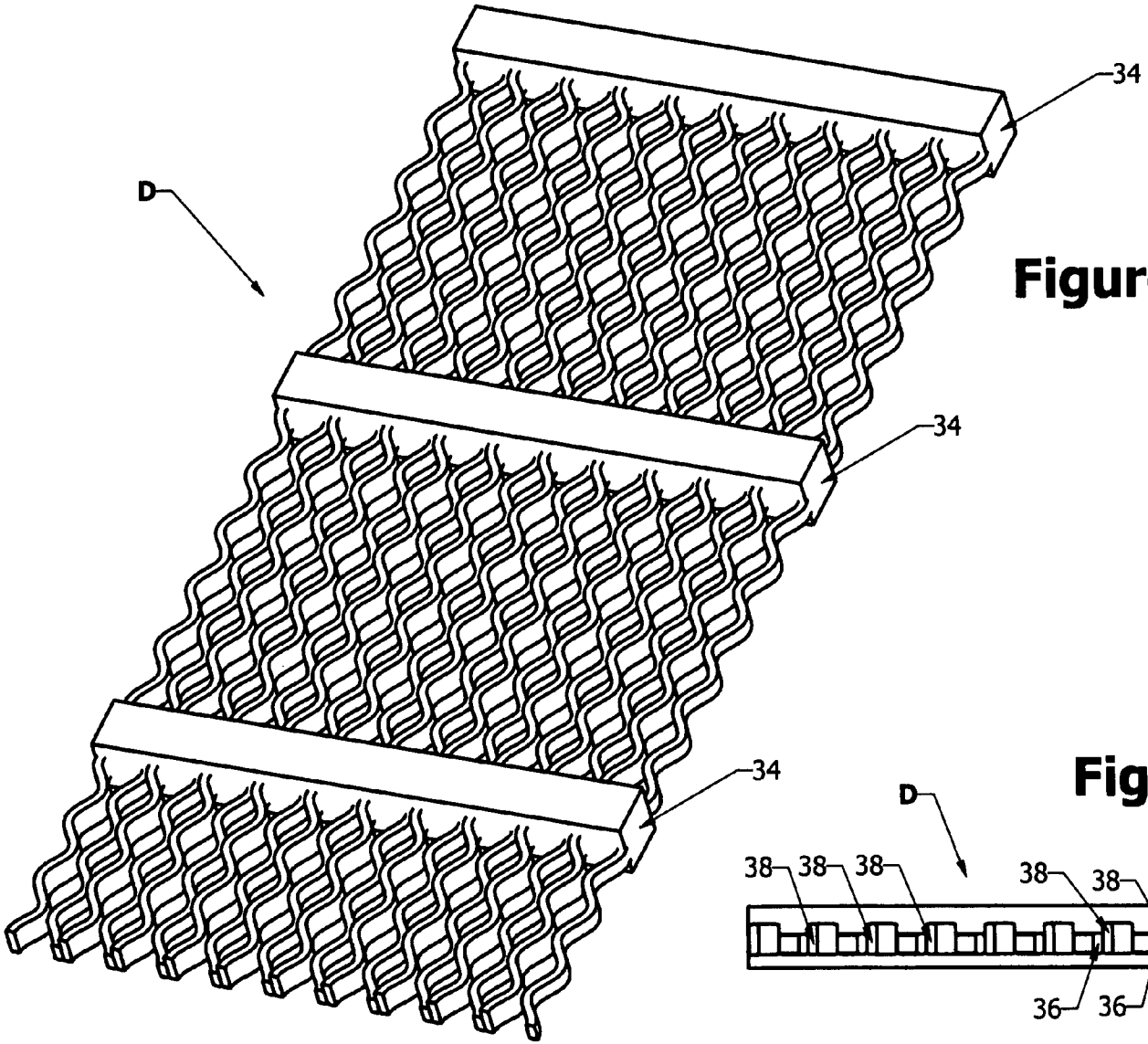
FIG. 8 is a perspective view of a portion of an integral non-woven wire screening or screen formed in accordance with a further preferred embodiment of the present invention.
Figure 9:
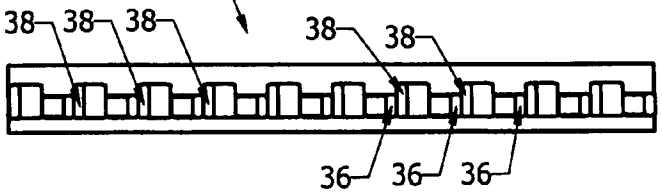
FIG. 9 is a side elevational view of the screening illustrated in FIG. 8.
Figure 10:
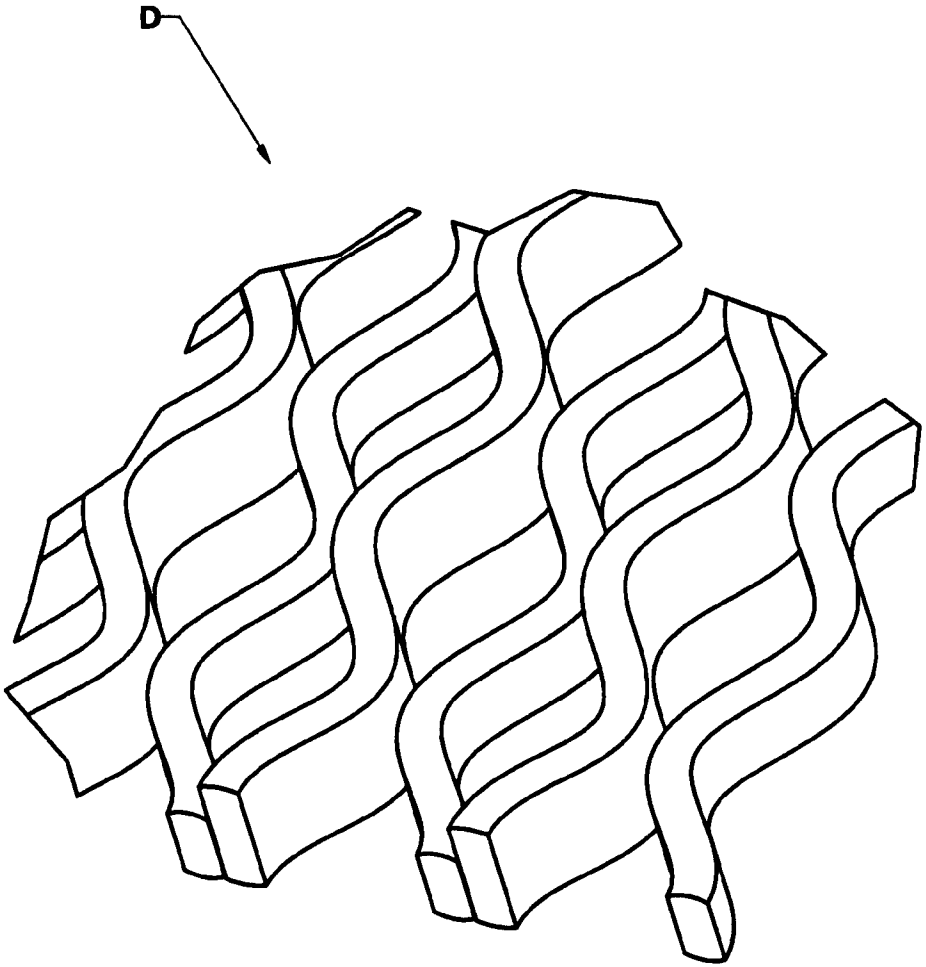
FIG. 10 is an enlarged fragmentary perspective view of an integral non-woven wire screening of the type illustrated in FIG. 8.

FIGS. 8 Through 10

Referring to FIGS. 8 through 10, a portion of an integral non-woven wire screening or screen D formed in accordance with another preferred embodiment of the present invention is illustrated in one of many possible configurations. It will be readily appreciated that the size of screen D can be varied as desired. Screen C is similar to screen A and, therefore, only the differences will be described in detail.

In this embodiment, the weft wires 4 in screen A have been replaced with retaining strips 34 spaced along the length of the warp screening elements. Preferably, the retaining strips 34 are formed from a non-metallic material (e.g., polyurethane). In the most preferred form of this embodiment, the retaining strips 34 are formed by molding a non-metallic material around the warp screening elements. Referring to FIG. 9, the lowermost surface of small warp screening elements 36 are in the same horizontal plane as the lowermost surfaces of the large warp screening elements 38. This arrangement allows the uppermost surfaces of the large warp screening elements 38 to extend above the uppermost surfaces of the small warp screening elements a distance equal to the difference in the height of the large warp screening elements 38 and the small warp screening elements 36. It should be noted that this arrangement may be reversed, i.e., the upper most surfaces of the small and large warp screening elements can be in the same horizontal plane while the lowermost surfaces of the large warp screening elements extend below the lowermost surfaces of the small warp screening elements a distance equal to the difference in the height of the large warp screening elements and the small warp screening elements.

Figure 11:
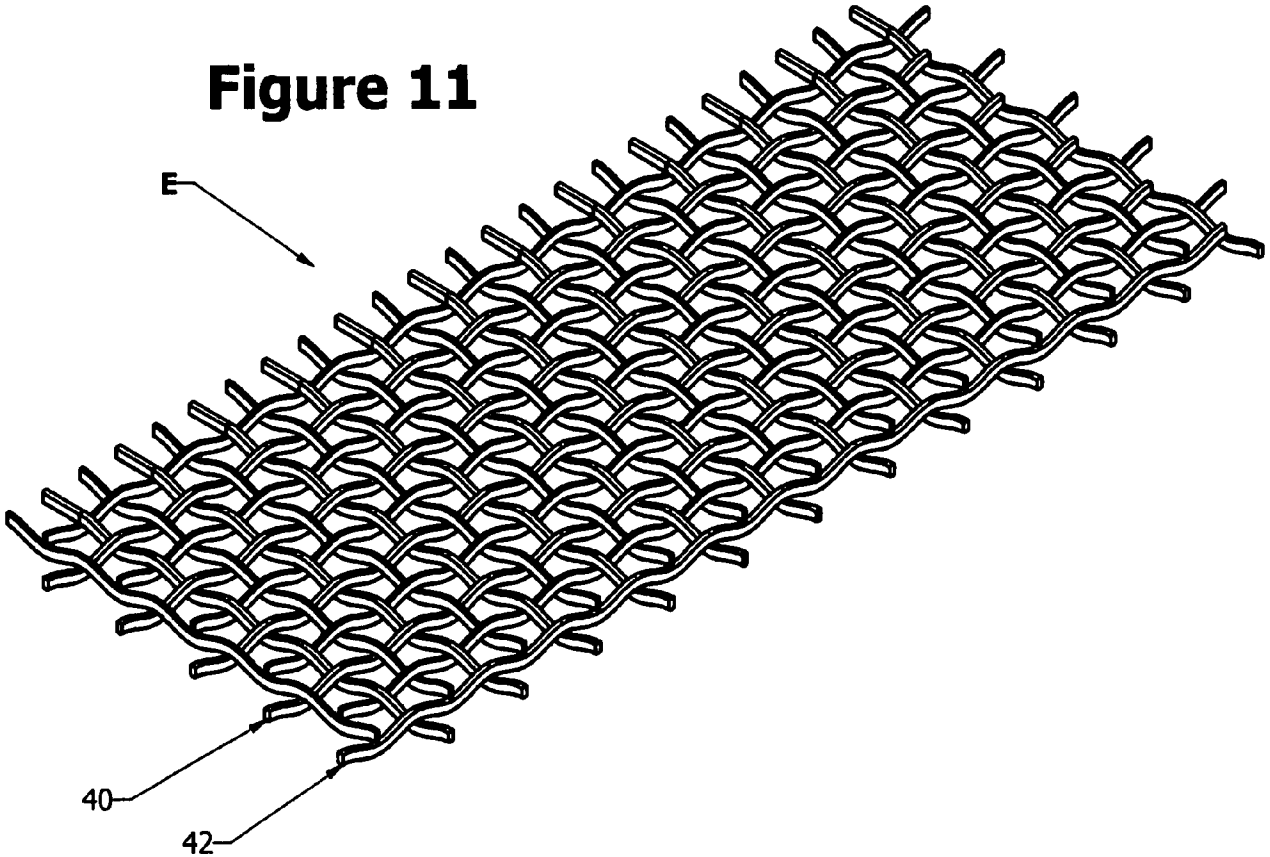
FIG. 11 is a perspective view of a portion of an integral woven wire screening or screen formed in accordance with still a further preferred embodiment of the present invention.
Figure 12:
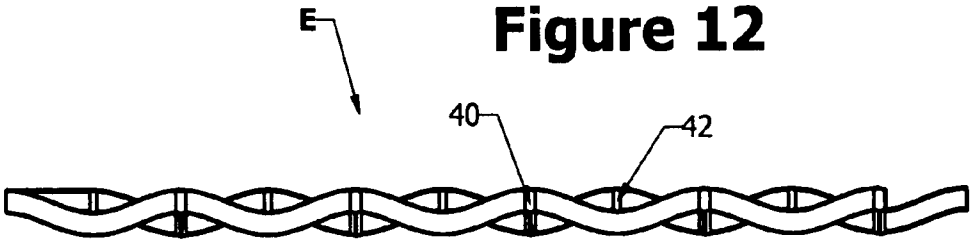
FIG. 12 is a side elevational view of the screening illustrated in FIG. 11.
Figure 13:
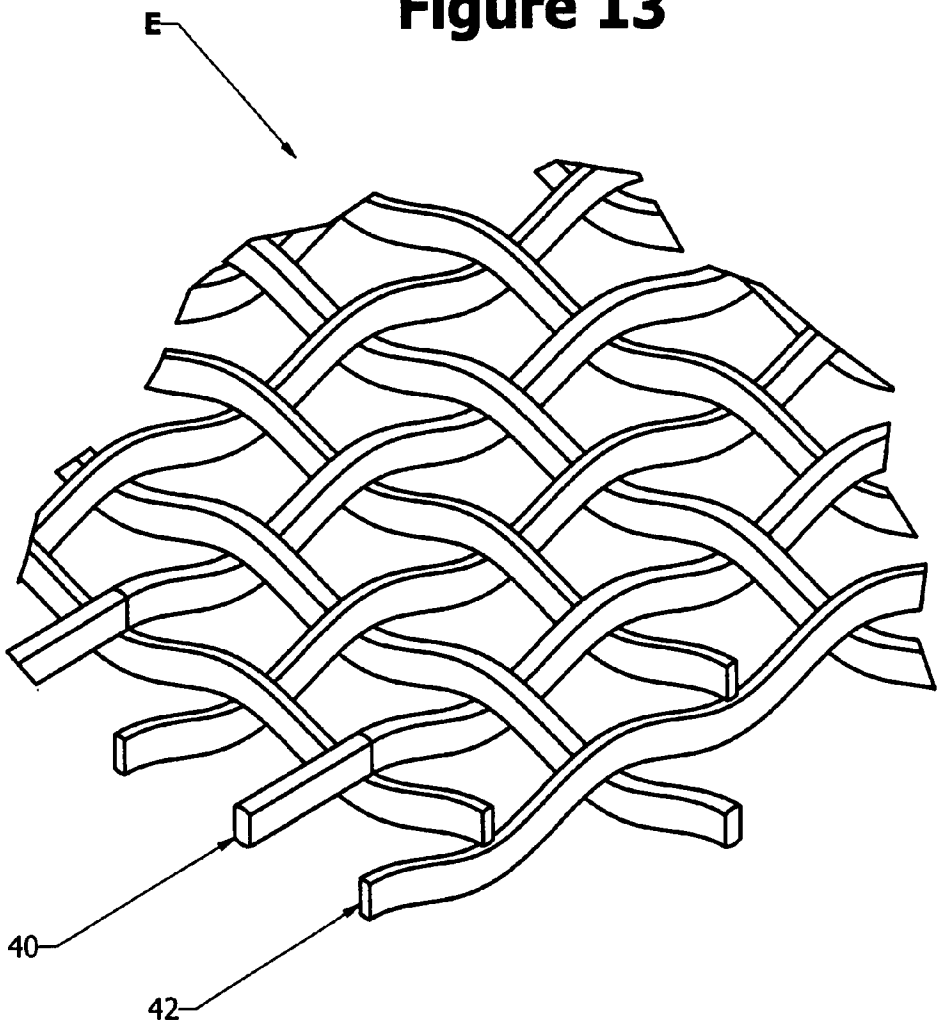
FIG. 13 is an enlarged fragmentary perspective view of an integral woven wire screening of the type illustrated in FIG. 11.

FIGS. 11 Through 13

Referring to FIGS. 11 through 13, a portion of an integral woven wire screening or screen E formed in accordance with another preferred embodiment of the present invention is illustrated in one of many possible configurations. Screen E is similar to the preferred embodiment disclosed in U.S. Pat. No. 7,815,053, the contents of which are incorporated herein by reference. While utilizing the principles of the preferred embodiment of U.S. Pat. No. 7,815,053, screen E further includes alternating warp screening elements having differing spring rates to allow screen E to be self-cleaning. Referring to FIG. 13, the warp screening elements alternate between large warp screening elements 40 and small warp screening elements 42 varying the spring rate between the large and small warp screening elements. The spring rate can also be varied by varying the hardness of the warp screening elements alone or along with varying the size of the warp screening elements. The arrangement of the warp screening elements having differing spring rates can be varied as desired including but not limited to all of the arrangements previously discussed. As opposed to varying the spring rate of the warp screening elements, the spring rate of the weft screening elements can be varied in any manner previously described. In addition, the spring rates of both the weft screening elements and the warp screening elements may be varied in any manner previously described.

While this invention has been described as having a preferred design, it is understood that the preferred design can be further modified or adapted following in general the principles of the invention and including but not limited to such departures from the present invention as come within the known or customary practice in the art to which the invention pertains. The claims are not limited to the preferred embodiment and have been written to preclude such a narrow construction using the principles of claim differentiation.

We claim:

1. A screening for use in classifying material flowing through said screening, said screening comprising:

(a) a plurality of warp screening elements, said plurality of warp screening elements includes a first warp screening element having a plurality of horizontal undulations, said plurality of warp screening elements further including a second warp screening element having a plurality of horizontal undulations;

(b) at least one retaining member operably associated with said plurality of warp screening elements to form an integral screen segment having a plurality of openings for permitting material to be classified to pass through said openings; and, (c) said first warp screening element having at least one characteristic different from said second warp screening element to prevent blinding of said integral screen segment, said at least one characteristic affecting movement of said first warp screening element and said second warp screening element when said integral screen segment is used to classify material such that at least one of amplitude and frequency of movement of said first warp screening element is different from at least one of amplitude and frequency of movement of said second warp screening element when said first warp screening element and said second warp screening element are subject to the same operating condition, said at least one characteristic being spring rate, said first warp screening element having a first spring rate and said second screening element having a second spring rate, said first spring rate is different from said second spring rate.

2. A screening as set forth in claim 1, wherein:

(a) said first warp screening element is larger than said second warp screening element, said first spring rate is less than said second spring rate.

3. A screening as set forth in claim 2, wherein:

(a) said first warp screening element is formed from a wire two wire sizes larger than a wire used to form said second warp screening element, a ratio of said second spring rate to said first spring rate ranges from approximately 4 to 1 to approximately 5 to 1.

4. A screening as set forth in claim 1, wherein:

(a) said first warp screening element is larger than said second warp screening element, said first spring rate is greater than said second spring rate.

5. A screening as set forth in claim 4, wherein:

(a) said first warp screening element has a hardness less than said second warp screening element.

6. A screening for use in classifying material flowing through said screening, said screening comprising:

(a) a plurality of warp screening elements, said plurality of warp screening elements includes a first warp screening element, said first warp screening element having an uppermost surface and a lowermost surface, said plurality of warp screening elements further including a second warp screening element having an uppermost surface and a lowermost surface; and, (b) at least one retaining member operably associated with said plurality of warp screening elements to form an integral non-woven screen segment having a plurality of openings for permitting material to be classified to pass through said openings, said at least one retaining member positioning said first warp screening element and said second warp screening element such that one of the following two conditions exist: (i) said lowermost surface of said first warp screening element and said lowermost surface of said second warp screening element are in a first horizontal plane and said uppermost surface of said first warp screening element is a predetermined distance above said uppermost surface of said second warp screening element; and, (ii) said uppermost surface of said first warp screening element and said uppermost surface of said second warp screening element are in a second horizontal plane and said lowermost surface of said first warp screening element is a predetermined distance below said lowermost surface of said second warp screening element.

7. A screening as set forth in claim 6, wherein:

(a) said first warp screening element has a plurality of horizontal undulations, said second warp screening element has a plurality of horizontal undulations.

8. A screening as set forth in claim 7, wherein:

(a) said at least one retaining member is formed from a non-metallic material.

9. A screening as set forth in claim 8, wherein:

(a) said at least one retaining member is formed from polyurethane.

10. A screening as set forth in claim 9, wherein:

(a) said first warp screening element is a first warp wire, said second screening element is a second warp wire, said first warp wire is more than one wire size greater than said second warp wire, said first warp wire and said second warp wire each have at least two substantially flat sidewalls, said predetermined distance below and said predetermined distance above is equal to the difference in height of said first warp wire and said second warp wire.

11. A screening as set forth in claim 10, wherein:

(a) at least one of said plurality of openings is formed by only said first warp wire and said second warp wire.

12. A screening as set forth in claim 11, wherein:

(a) said plurality of openings in said non-woven screen segment have at least four sides.

13. A screening as set forth in claim 12, wherein:

(a) said plurality of openings in said non-woven screen segment are substantially diamond shape.

14. A screening for use in classifying material flowing through said screening, said screening comprising:

(a) a plurality of warp screening elements, said plurality of warp screening elements includes a first warp screening element, said first warp screening element having a first hardness, said plurality of warp screening elements further including a second warp screening element having a second hardness, said first hardness being different from said second hardness; and, (b) at least one retaining member operably associated with said plurality of warp screening elements to form an integral screen segment having a plurality of openings for permitting material to be classified to pass through said openings, said at least one retaining member permitting movement of said first warp screening element and said second warp screening element when said integral screen segment is used to classify material where the difference in hardness between said first warp screening element and said second warp screening element causes at least one of amplitude and frequency of movement of said first warp screening element and at least one of amplitude and frequency of movement of said second warp screening element to be different when said first warp screening element and said second warp screening element are subject to the same operating condition.

15. A screening as set forth in claim 14, wherein:

(a) said first warp screening element is a first warp wire and said second screening element is a second warp wire, said first warp wire and said second warp wire each have two substantially flat sidewalls, said first warp wire is formed from a wire more than one wire size greater than a wire from which said second warp wire is formed.

16. A screening as set forth in claim 15, wherein:

(a) said first warp wire has a spring rate greater than said second warp wire.

17. A screening as set forth in claim 15, wherein:

(a) a ratio of spring rate of said second warp wire to spring rate of said first warp wire ranges from approximately 4 to 1 to 5 to 1.

18. A screening as set forth in claim 15, wherein:

(a) said second warp wire is formed from a wire having a wire size of at least 0.032 inches and no greater than 0.4375 inches, said first warp wire is formed from a wire two wire sizes greater than a wire from which said second warp wire is formed, said plurality of undulations in said first warp wire and said second warp wire are horizontal undulations, said plurality of openings each have at least four sides formed solely by said first warp wire and said second warp wire.

19. A screening for use in classifying material flowing through said screening, said screening comprising:

(a) a plurality of warp screening elements, said plurality of warp screening elements includes a first warp screening element having a plurality of undulations, said plurality of warp screening elements further including a second warp screening element having a plurality of undulations, at least one of said first warp screening element and said second warp screening element having two substantially flat sidewall portions;

(b) at least one retaining member operably associated with said plurality of warp screening elements to form an integral screen segment having a plurality of openings for permitting material to be classified to pass through said openings; and, (c) said first warp screening element having a first spring rate, said second warp screening element having a second spring rate, said second spring rate being different from said first spring rate.

20. A screening element as set forth in claim 19, wherein:

(a) said first warp screening element is a first warp wire having a plurality of horizontal undulations, said second warp screening element is a second warp wire having a plurality of horizontal undulations, said first warp wire is formed from a wire at least two wire sizes greater than a wire from which said second warp wire is formed, said first spring rate is less than said second spring rate.

21. A screening element as set forth in claim 19, wherein:

(a) said first warp screening element is a first warp wire having a plurality of horizontal undulations, said second warp screening element is a second warp wire having a plurality of horizontal undulations, said first warp wire is at least two wire sizes greater than said second warp wire, said first spring rate is greater than said second spring rate.

22. A screening for use in classifying material flowing through said screening, said screening comprising:

(a) a plurality of warp screening elements, said plurality of warp screening elements includes a first warp screening element having a plurality of undulations, said plurality of warp screening elements further including a second warp screening element having a plurality of undulations, at least one of said first warp screening element and said second warp screening element having two substantially flat sidewall portions;

(b) at least one retaining member operably associated with said plurality of warp screening elements to form an integral screen segment having a plurality of openings for permitting material to be classified to pass through said openings; and, (c) said first warp screening element having at least one characteristic different from said second warp screening element to prevent blinding of said integral screen segment, said at least one characteristic affecting movement of said first warp screening element and said second warp screening element when said integral screen segment is used to classify material such that at least one of amplitude and frequency of movement of said first warp screening element is different from at least one of amplitude and frequency of movement of said second warp screening element when said first warp screening element and said second warp screening element are subject to the same operating condition, said at least one characteristic being at least one of wire size and hardness.

23. A screening as set forth in claim 22, wherein:

(a) said first warp screening element is a first warp wire and said second screening element is a second warp wire, said first warp wire is formed from a wire at least two wire sizes greater than a wire from which said second warp wire is formed, said first warp wire has a hardness different than said second warp wire, each of said plurality of openings has at least four sides formed solely by said first warp wire and said second warp wire.

24. A screening as set forth in claim 22, wherein:

(a) said integral screen segment is a non-woven integral screen.

25. A screening for use in classifying material flowing through said screening, said screening comprising:

(a) a plurality of warp screening elements, said plurality of warp screening elements including a first group of warp screening elements having at least first and second warp screening elements, said first and second warp screening elements each having a plurality of horizontal undulations, said plurality of warp screening elements further including a second group of warp screening elements including third and fourth warp screening elements, said third and fourth warp screening elements each having a plurality of horizontal undulations, said first warp screening element being positioned directly adjacent said second warp screening element such that no warp screening element is positioned between said first warp screening element and said second warp screening element, said third warp screening element being positioned directly adjacent said fourth warp screening element such that no warp screening element is positioned between said third warp screening element and said fourth warp screening element;

(b) at least one retaining member operably associated with said plurality of warp screening elements to form an integral screen segment having a plurality of openings for permitting material to be classified to pass through said openings; and, (c) said first warp screening element and said second warp screening element each having a first spring rate, at least one of said third warp screening element and said fourth warp screening element having a second spring rate, said first spring rate being different from said second spring rate to prevent blinding of said integral screen segment.

26. A screening as set forth in claim 25, wherein:

(a) said third and fourth warp screening elements each have the second spring rate.

* * * * *